United States Patent [19]

King

[11] Patent Number: 4,974,560

[45] Date of Patent: Dec. 4, 1990

[54] MECHANISM FOR VARYING VALVE DURATION IN AN INTERNAL COMBUSTION ENGINE

[76] Inventor: Brian T. King, 48000 Elkview Rd., RR2, Sardis, British Columbia, Canada, V2R 1B1

[21] Appl. No.: 496,651

[22] Filed: Mar. 21, 1990

[51] Int. Cl.[5] ..... F01L 1/04

[52] U.S. Cl. ..... 123/90.17; 123/90.31

[58] Field of Search ..... 123/90.12, 90.15, 90.17, 123/90.31

[56] References Cited

U.S. PATENT DOCUMENTS

| | | | |
|---|---|---|---|
| 4,561,390 | 12/1985 | Nakamura | 123/90.15 |
| 4,674,452 | 6/1987 | Asanomi | 123/90.31 |
| 4,716,864 | 1/1988 | Binder | 123/90.31 |
| 4,805,566 | 2/1989 | Ampferer | 123/15 |
| 4,895,113 | 1/1990 | Speier | 123/90.17 |

FOREIGN PATENT DOCUMENTS

| | | | |
|---|---|---|---|
| 3247916 | 6/1984 | Fed. Rep. of Germany | 123/90.17 |
| 0165511 | 9/1983 | Japan | 123/90.17 |
| 2109858 | 6/1983 | United Kingdom | 123/90.17 |

*Primary Examiner*—Charles J. Myhre
*Assistant Examiner*—Weilun Lo

[57] ABSTRACT

A device for varying optimally, throughout the operating range of an internal combustion engine, the duration of the processes of induction and exhaust. The device employing, within a common combustion chamber, two valves for each of the processes of induction and exhaust; each of the two valves being driven by a different camshaft; the two camshafts so employed being capable of variable angular indexing with respect to each other, and with respect to crankshaft revolution, by means of a camshaft indexing variator; the variable indexing so achieved causing variable indexing of the two valves relative to each other, whereby, for instance, one valve of a pair may be caused to open at an advanced indexing, relative to crankshaft revolution, and the other valve to open at a retarded indexing, relative to crankshaft revolution; the advanced opening point of one valve, and the retarded closing point of the other valve defining an extended duration of the process associated with the two valves.

15 Claims, 11 Drawing Sheets

MECHANISM FOR VARYING VALVE DURATION IN AN INTERNAL COMBUSTION ENGINE

BACKGROUND OF THE INVENTION

It is recognized in the art that the non-variable nature of valve duration in the internal combustion engine is a serious impediment to optimal efficiency. The varying dynamics of an engine having optimal efficiency throughout the range of it's operation would demand continuous adjustments in the duration relative to crankshaft revolution, of the processes of induction and exhaust.

The benefits of such a system would be considerable improvements in the areas of economy, reduced emmission levels and increased power. The benefits to torque characteristics of such an engine would allow smaller engines for given vehicle weight; the weight saving so achieved improving overall vehicle efficiency still further.

In view of these facts, many attempts have been made to provide a mechanism capable of giving at least some of the above benefits.

The difficulties in producing such inventions lie, not in designing reliable mechanisms to bodily re-index a camshaft relative to crankshaft revolution, since one or two such systems are in production—Mercedes and Toyota, for example—but are capable of achieving only a minor effect since a simple reindexing of the camshaft cannot provide a variation in the duration of an induction or exhaust process.

Accordingly, attempts have been made, for instance, to apply the aforesaid principle of re-indexing to a pair of camlobes operating a single valve, with mechanisms that attempt to combine the motion of the opening flank of a first camlobe with the motion of the closing flank of a second camlobe, and by variably indexing the two camlobes relative to each other, producing a variation in the duration of the valve.

Results stemming from this approach illustrate the extreme difficulty in combining the disparate motions generated by two camlobes differentially phased into a single motion of use in this context. FIG. 11 of the drawings depicts a sample of this dynamically unacceptable valve motion.

Accordingly, a system is proposed by the inventor that provides continuously variable duration of the exhaust and induction processes, without altering the duration of the valves associated with such processes, and without departing from the dynamics of camlobe/-valve relationships that are proven in all engines having conventional non-variable valve train systems. The aforesaid system requiring, in part, the use of two camshafts, and a mechanism to variably re-index these camshafts relative to each other, and relative to crankshaft revolution, prior art camshaft variable indexing mechanisms are referenced, for example, such as GARCEA November 4, 1980, U.S. Pat. No. 4,231,330, and AKASAKA et al Mar. 14, 1989, U.S. Patent No. 4,811,698, it being noted that both devices offer only the capability of angularly re-indexing a single camshaft.

SUMMARY OF THE INVENTION

It is an object of the present invention to provide variable duration, relative to crankshaft revolution, of the processes of induction and exhaust, in an internal combustion engine.

In order to achieve this object, it is proposed that, in a combustion chamber of an internal combustion engine, two valves be employed for each of the processes of induction and exhaust; that a first valve of a pair associated with a given process be caused to open at an advanced angular position, relative to crankshaft revolution; and the second valve of the same pair be caused to close at a retarded angular position relative to crankshaft revolution; the advanced opening point of the first valve, and the retarded closing point of the second valve defining an extended duration, relative to crankshaft revolution, of the process associated functionally with the pair of valves. FIG. 12 depicts two valves of common function within a combustion chamber differentially phased to produce an 80 degree extension of duration of a process of induction or of exhaust; the curves of valve lift, and resulting curve of the combined valve open area of the two valves.

It being necessary, in the preferred embodiments, to employ two camshafts; the angular indexing of two camshafts being controlled by a camshaft indexing variator; the first camshaft having lobes to operate within a combustion chamber having two valves for the process of induction and two valves for the process of exhaust, an inlet valve and an exhaust valve; the second camshaft likewise having lobes to operate, within the same combustion chamber, an inlet valve and an exhaust valve. The two camshafts employed in this embodiment of the invention are spaced with axis parallel to each other. The first camshaft is connected for driving purposes with a first driven cam pulley connected driveably to a crankshaft pulley by an endless wrapping connector such as a toothed belt or a chain. The mechanism for connecting the first driven cam pulley and the first camshaft has means for varying the phasing of the first driven cam pulley and the first camshaft; this means being helical teeth on both the first camshaft and the first driven cam pulley; these helical teeth being connected operatively by a first ring gear interposed between the first camshaft and the first driven cam pulley wherein helical teeth in the first ring gear mesh with the helical teeth on the first camshaft and the first driven cam pulley. This helically toothed first ring gear is capable, by virtue of hydraulic pressure means, of axial movement, which movement urges the first camshaft to rotate angularly relative to the first driven cam pulley, thus adjusting the relative phasing between the first driven cam pulley and the first camshaft. As the first ring gear is moved axially, as stated, it bears against, and causes to move an equal distance, a second ring gear which has helical teeth in mesh with a third set of helical teeth on the first driven cam pulley, and with fourth helical teeth on an intermediate driven pulley which is disposed concentrically around the first camshaft; the second helically toothed ring gear being interposed between an extension of the first driven cam pulley housing and the intermediate driven pulley. Axial movement of the second ring gear causes the intermediate driven pulley to rotate angularly relative to the first driven cam pulley, thus adjustinq the relative phasing between the first driven cam pulley and the intermediate driven pulley. It should be noted that the helical teeth connecting the first driven cam pulley to the first camshaft; and the first driven cam pulley to the intermediate driven pulley are of opposite pitch and that therefore the angular rotation of the first camshaft relative to the first driven cam pulley is directionally of opposite angular displacement to the angular displacement that takes place between the intermediate driven pulley and the first driven cam pulley. Thus, by connecting, by means of an endless wrapping connector, the intermediate driven pulley and the second driven can pulley connected fixedly to the second camshaft, it is possible, simultaneously, to angularly re-phase, in opposite rotational directions, the first camshaft and the second camshaft The two camshafts, and thus the valves reciprocated by the two camshafts, being capable of variable angular indexing relative to crankshaft revolution it can be seen that subject to an engine control system metering hydraulic pressure to the herein above described camshaft indexing variatore, the duration, relative to crankshaft revolution, of the processes of induction and exhaust may be optimally controlled within an internal combustion engine.

DETAILED DESCRIPTION OF THE PREFERRED EMBODIMENTS

Figure 2:
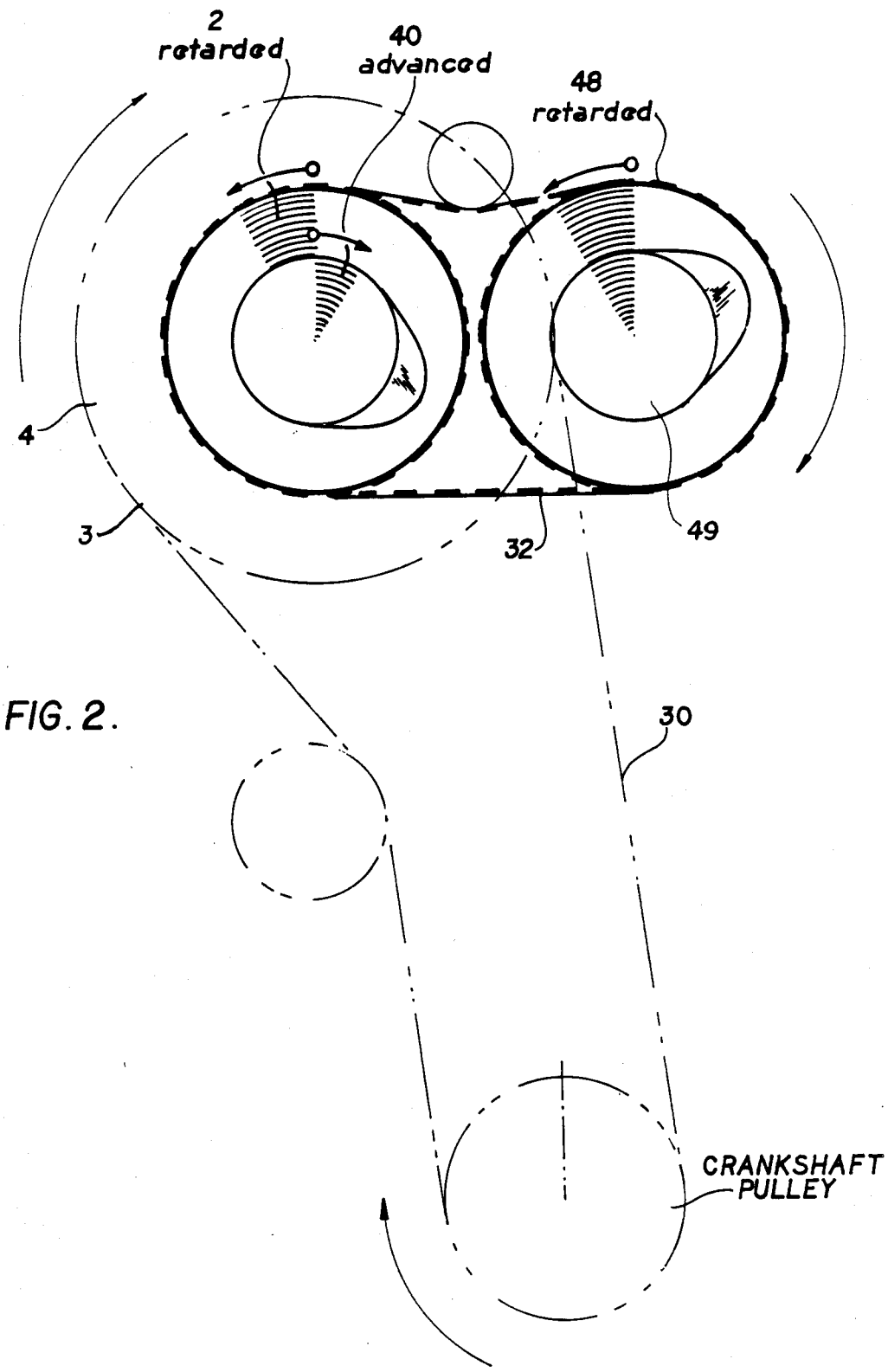
FIG. 2 is a frontal elevation diagram of the camshaft indexing variator 4 and connecting drive means.
Figure 3:
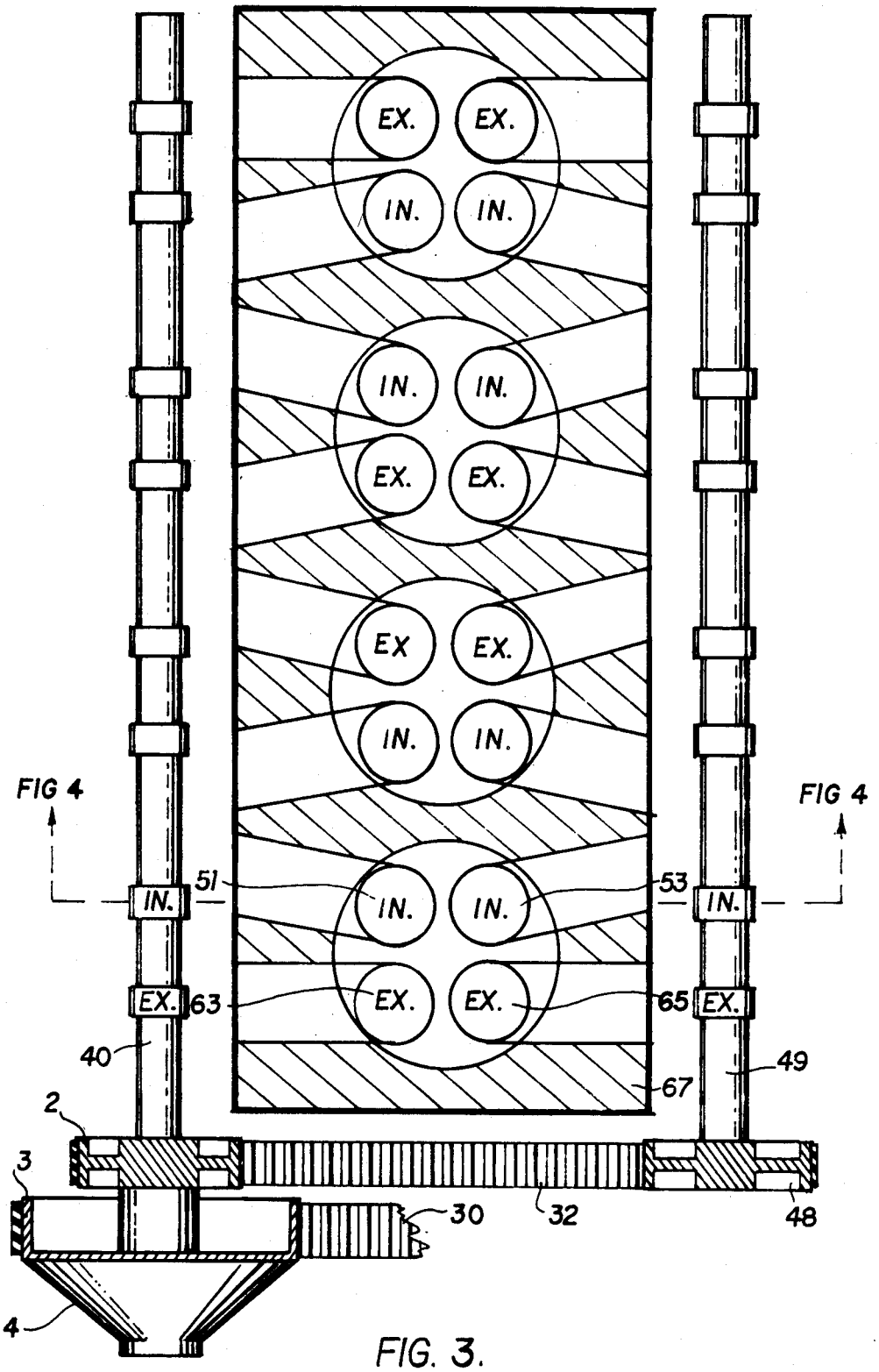
FIG. 3 is a plan view diagram showing the valve layout in a four valve cylinder head, the general arrangement of camshafts and camshaft indexing variator 4.
Figure 4:
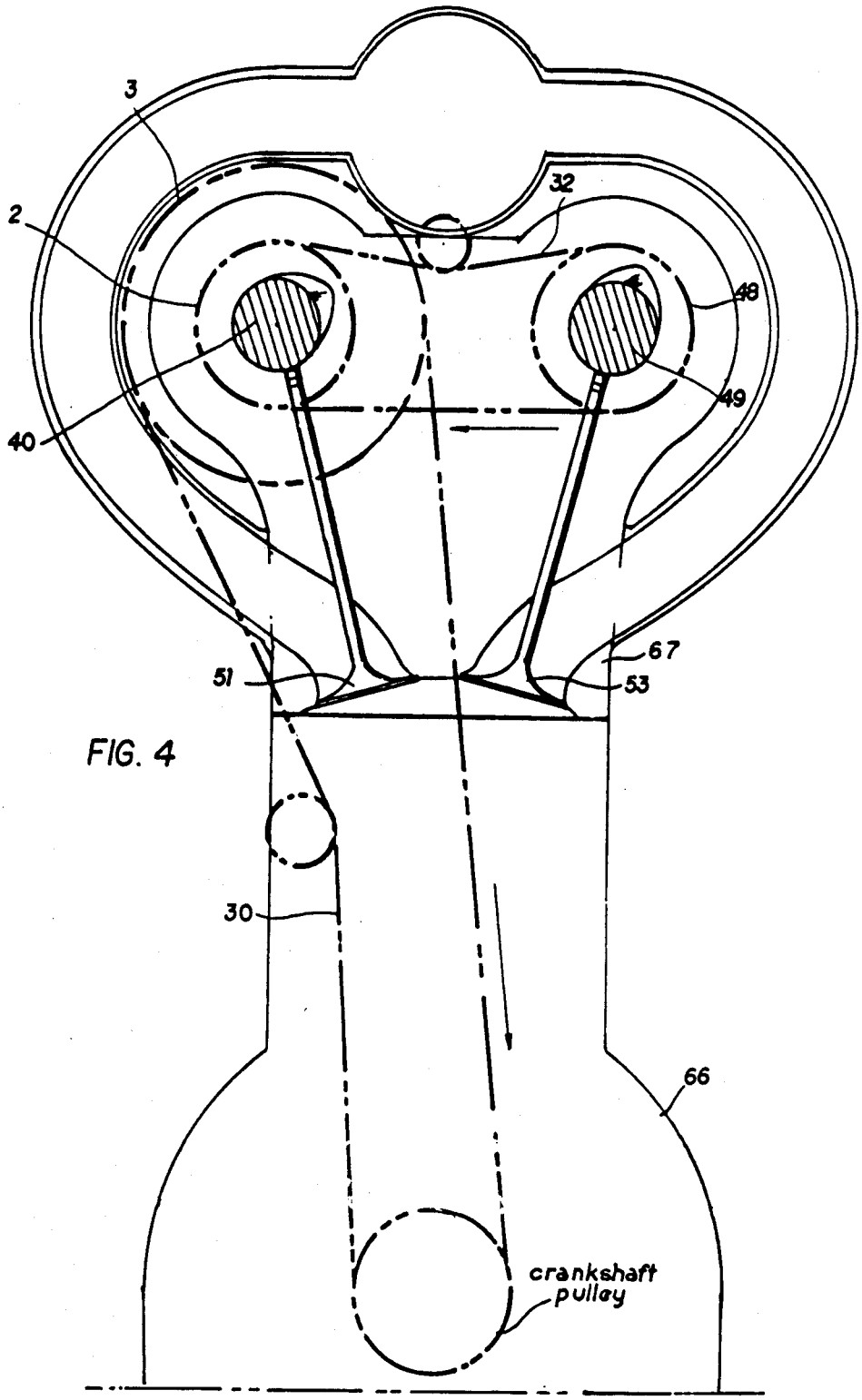
FIG. 4 is a frontal elevation part sectional diagram of the cylinder head layout in FIG. 3.

FIGS. 2, 3 and 4 show a preferred embodiment of the present invention. FIG. 3 shown diagramatically an arrangement of two inlet valves and two exhaust valves within each combustion chamber of a cylinder head 67 for a four cylinder in-line engine. However, this arrangement is not an essential feature of the present invention.

Shown, are the induction and exhaust conduits fluidly connecting inlet and exhaust valves to ports located in external faces of cylinder head 67, and the general positional relationship of the laterally spaced camshafts 40 and 49 to the intake valves 51 and 53, and exhaust valves 63 and 65. FIG. 2 shows diagramatically a frontal elevation of the cam driving mechanism of the preferred embodiments; wherein, in phantom, first driven cam pulley 3 is drivingly connected by an endless wrapping connector 30 to the crankshaft pulley. Camshaft indexing variator 4 for varying camshaft angularity is shown preferably mounted to first camshaft 40; first driven cam pulley 3 being fixed in rotation with camshaft indexing variator 4. Intermediate driven pulley 2, of common axis with first camshaft 40, is shown drivingly connected by endless wrapping connector 32 to second driven cam pulley 48 fast in rotation with second camshaft 49. To facilitate understanding of variable camshaft re-indexing due to actuation of camshaft indexing variator 4, first camshaft 40 is shown at an advanced indexing relative to first driven cam pulley 3; while intermediate driven pulley 2 is shown at a retarded indexing relative to first driven cam pulley 3. The second driven cam pulley 48, and, therefore, second camshaft 49 fixed in rotation with second driven cam pulley 48, are connected drivingly with intermediate driven pulley 2 by endless wrapping connector 32. Thus, the second camshaft 49 is shown at a retarded indexing relative to first driven cam pulley 3; and, therefore, the first camshaft 40 is shown advanced, and the second camshaft 49 is shown retarded, relative to crankshaft revolution. FIG. 4 depicts, diagramatically, a frontal elevation of an engine of the preferred embodiments, the general layout being as in FIG. 3; but showing additionally, first and second inlet valves 51 and 53, and an embodiment of the induction ducting preferably associated with valves 51 and 53.

It should be here noted that endless wrapping connectors 30 and 32 could be chains, and that the first driven cam pulley 3, intermediate driven pulley 2 and second driven cam pulley 48 could be toothed sprockets to receive chains; or that the drive system could comprise a combination of both types of drive media named hereinabove.

Figure 1:
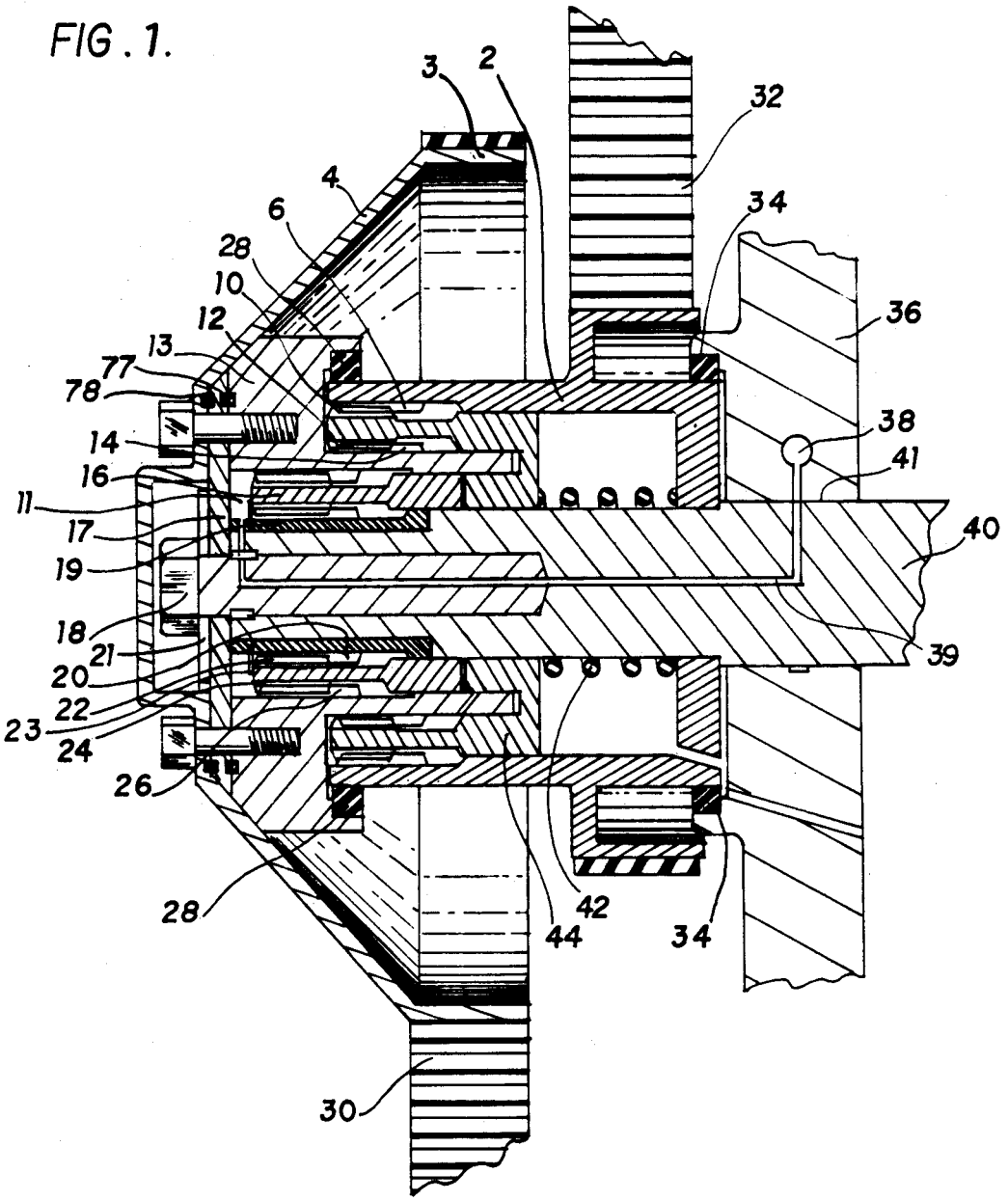
FIG. 1 is a sectional drawing of the camshaft indexing variator 4.

The preferred embodiment of the camshaft indexing variator 4 shown in FIG. 1 carries a toothed pulley 3 for driving by the engine, through the medium of an endless wrapping connector 30. Pulley 3 is connected by a conical section to the housing 13 of the device. Housing 13 has helical gear teeth 12 and 26. Helical gear teeth 12 are formed on an outer periphery of a cylindrical section of housing 13; while helical gear teeth 26 are formed on the inner periphery of a cylindrical section of housing 13.

It is a preferred feature of the present invention that first driven cam pulley 3 can be readily disconnected from the main housing 13 of camshaft indexing variator 4 in order to facilitate servicing of endless wrapping connector 32 drivingly connecting intermediate driven pulley 2 and second driven cam pulley 48. This feature is necessary when first and second camshafts are arranged with axis close together, necessitating a short endless wrapping connector, which will not clear a fixed first driven cam pulley.

First camshaft 40 has a stepped axial end of reduced diameter fitted with an essentially cylindrical sleeve 19 carrying out helical gear teeth 20, which oppose, across a radial clearance, inner helical gear teeth 26 on housing 13. Bolt 18 secures camshaft indexing variator 4 to camshaft 40 and has an axial passageway 39 constituting part of fluid path 39; fluid path 39 being in communication with a pressure source 38 for the working fluid, e.g. engine lubricant. Axial passageway 39 in bolt 18 has radial passageways communicating with an inner volume deployed radially around bolt 18 defined by camshaft 40, housing 13, cover plate 17 and first ring gear 16; this inner volume defining a hydraulic pressure chamber. Spacing washer 21 situated between the head of bolt 18 and cover plate 17 is of a thickness to permit free rotation of camshaft indexing variator 4 relative to first camshaft 40.

It should be noted that the working fluid, e.g. engine lubricating oil flowing through fluid path 39 may also serve as a lubricant for a bearing section 41 in engine housing 41 in per se well known manner; and, further, that the hydraulic fluid medium is prevented from leaking to the exterior of camshaft indexing variator 4 by seals 28, 34, 77 and 78.

A first ring gear 16 is inserted between the inner periphery of housing 13 having helical gear teeth 26, and the outer periphery of sleeve 19 on which helical gear teeth 20 are formed. First ring gear 16 is retained by retainer ring 23.

The first ring gear 16 inner helical gear teeth 22 and outer helical gear teeth 24 engage; inner helical gear teeth 26 on housing 13, and outer sleeve 19 helical gear teeth 20 respectively. Therefore, rotation of first driven cam pulley 3 in synchronism with engine revolution is transmitted to the camshaft 40 through first ring gear 16 and sleeve 19.

Intermediate driven pulley 2 has inner helical gear teeth 6 which oppose, across a radial space, outer helical gear teeth 14 on housing 13. Inserted between intermediate driven pulley 2 and housing 13 is second ring gear 44. Inner helical gear teeth 12 on second ring gear 44 engage with outer helical gear teeth 14 on housing 13. Outer helical gear teeth 10 on second ring gear 44 engage with inner helical gear teeth 6 on intermediate driven gear 44.

Therefore, rotation of first driven cam pulley 3 in synchronism with engine revolution is transmitted to the intermediate driven pulley 2 through second ring gear 44.

It should be noted that the pitch of helical gear teeth associated operatively with second ring gear 44 is of opposite pitch to that associated with first ring gear 16 - more on this, later.

First ring gear 16 has an end facing cover plate 17 and an end facing second ring gear 44. Second ring gear 44 has an end facing biasing spring 42. Therefore, hydraulic pressure in pressure chamber 11 urges first ring gear 16 axially away from cover plate 17 towards second ring gear 44; second ring gear 44 moves axially together with first ring gear 16 in a direction opposite to the biasing pressure of biasing spring 42; the balance between hydraulic pressure and biasing spring pressure determining the amount of axial movement of first and second ring gears 16 and 44, and thus the amount of angular displacement of first camshaft 40 and second camshaft 49.

Figure 9:
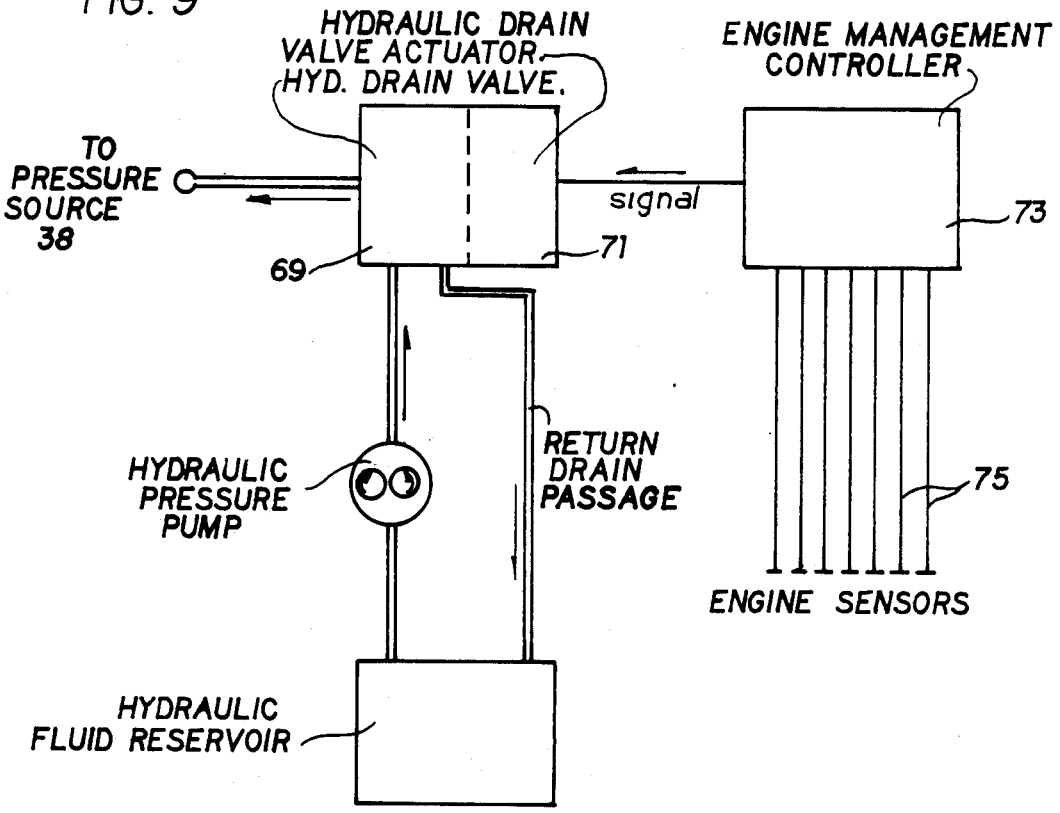
FIG. 9 is a control system schematic diagram.

Turning to FIG. 9 the fluid path 39 as shown in FIG. 1 is also connected to a drain valve 69 which communicates with a drain passage to recirculate the working fluid to the fluid reservoir. The drain valve 69 is connected to a control actuator 71 which actuates the valve between its open and closed positions. Control actuator 71 is electrically connected to an engine management controller 73 to receive therefrom a control signal. Controller 73 is connected to sensors 75 monitoring engine operating conditions, such as engine speed, air flow rate, inlet manifold pressure, throttle position and so forth. The controller 71 derives the control signal to activate or deactivate control actuator 69 in accordance with the derived engine operating conditions.

In practice, the preferred embodiment of the camshaft indexing variator 4, according to the present invention, controls duration, relative to crankshaft revolution, of one of a process of induction and exhaust by varying, relative to each other, for example, the phasing of a pair of valves, 51 and 53 jointly associated functionally with one of a process of induction and exhaust; the variable phasing of the aforementioned pair of valves being dependent on the variable phasing of the camshafts 40 and 49 driving the valves; the variable phasing of the camshafts 40 and 49 being dependant on the camshaft indexing variator 4 of the present invention; the camshaft indexing variator 4 being dependant on control mechanism as in FIG. 9 deriving its control signal from engine operating parameters monitored by sensors.

For example, considering only the factor of engine speed from among the factors considered for control purposes, when the engine speed is higher than, or equal to, an engine speed criterion determined according to desired engine performance, controller 73 outputs a HIGH-level control signal to order the control actuator 71 to actuate the drain valve 69 to a closed position. As a result, fluid pressure from source 38 is introduced into pressure chamber 11. When the fluid pressure built up in the pressure chamber 11 overcomes the spring biasing force exerted on second ring gear 44 and thus on first ring gear 16, by biasing spring 42, the first and second ring gears 16 and 44 are shifted away from cover plate 17; this movement displacing angularly first ring gear 16 relative to housing 13, and camshaft 40 relative to first ring gear 16; thus, camshaft 40 is displaced angularly relative to housing 13. At the same time, second ring gear 44, being likewise caused to shift in a direction away from cover plate 17 is displaced angularly relative to housing 13. Intermediate driven pulley 2, therefore, is displaced angularly relative to second ring gear 44. Thus, intermediate driven pulley 2 is displaced angularly relative to housing 13. The second driven pulley 48, connected drivingly to intermediate driven pulley 2 by an endless wrapping connector 32, is caused to rotate in synchronism with intermediate pulley 2. The second 49 being fixed in rotation with intermediate driven pulley 2 is, therefore, displaced angularly relative to housing 13 integral with first driven cam pulley 3. These relationships among first driven cam pulley 3, first camshaft 40, intermediate driven pulley 2 and second camshaft 49 are shown in FIG. 2.

It will be noted that the helical gear teeth of first and second ring gears 16 and 44, and the helical gear teeth associated with them respectively, are of opposite pitch, and, that therefore axial motion of first ring gear 16 will produce an angular displacement of first camshaft 40 of opposite rotational direction to that produced by second ring gear 44 relative to intermediate driven pulley 2, and thus to second camshaft 49. Thus, a HIGH-level control signal, representing a demand for an extension of the duration, relative to crankshaft revolution, of a process of induction, for instance, will cause the first camshaft 40 drivingly associated with a first inlet valve 51 of a pair, to advance angularly, relative to crankshaft revolution; and the second camshaft 49 associated drivingly with a second inlet valve 53 of a pair to retard angularly, relative to crankshaft revolution; thus producing an extension of duration of the inlet process. It will be understood that an extension of the exhaust process is achieved simultaneously by the same means; the camlobe for operating the first inlet valve 51 of a pair being situated on the same first camshaft 40 as the camlobe for operating the first exhaust valve 63 of a pair; both the first exhaust valve 63, and the first inlet valve 51 therefore, opening at an advanced angularity, relative to crankshaft revolution when the first camshaft 40 is so advanced. Further, the camlobe for opening the second inlet valve 53 is situated on the same second camshaft 49 as the camlobe for operating second exhaust valve 65; both the second inlet valve 53, therefore, and the second exhaust valve 65, closing, at a retarded angularity, relative to crankshaft revolution, when the second camshaft 49 is so retarded. The advanced angular opening point, relative to crankshaft revolution, of first inlet valve 51 and first exhaust valve 63; and the retarded angular opening point, relative to crankshaft revolution, of second inlet valve 53, and second exhaust valve 65, defining an extended duration of each of the processes of induction and exhaust It will be still further understood that an extension of duration of a process of induction and exhaust is generally desirable with an increase in engine speed; one exception, for example, being when a high engine speed on small throttle opening, such as during steady-state cruising, may require a shorter induction and exhaust process duration than that required for the same engine speed during full throttle, full load conditions.

Returning to the hypothetical case wherein the device is responding only to engine speed criteria, when engine speed drops below the predetermined engine speed criterion, the control signal from the controller goes LOW. As a result, the fluid pressure source 38 and pressure chamber 11 both communicate with the drain passage, causing a drop in the pressure chamber 11. Therefore, the spring force of biasing spring 42 shifts first ring gear 44 and second ring gear 16 back towards cover plate 17, thus causing angular displacement of intermediate driven pulley 2, and first camshaft 40; thus returning the angular relationship between the first camshaft 40 and second camshaft 49 to it's initial state.

Figure 5:
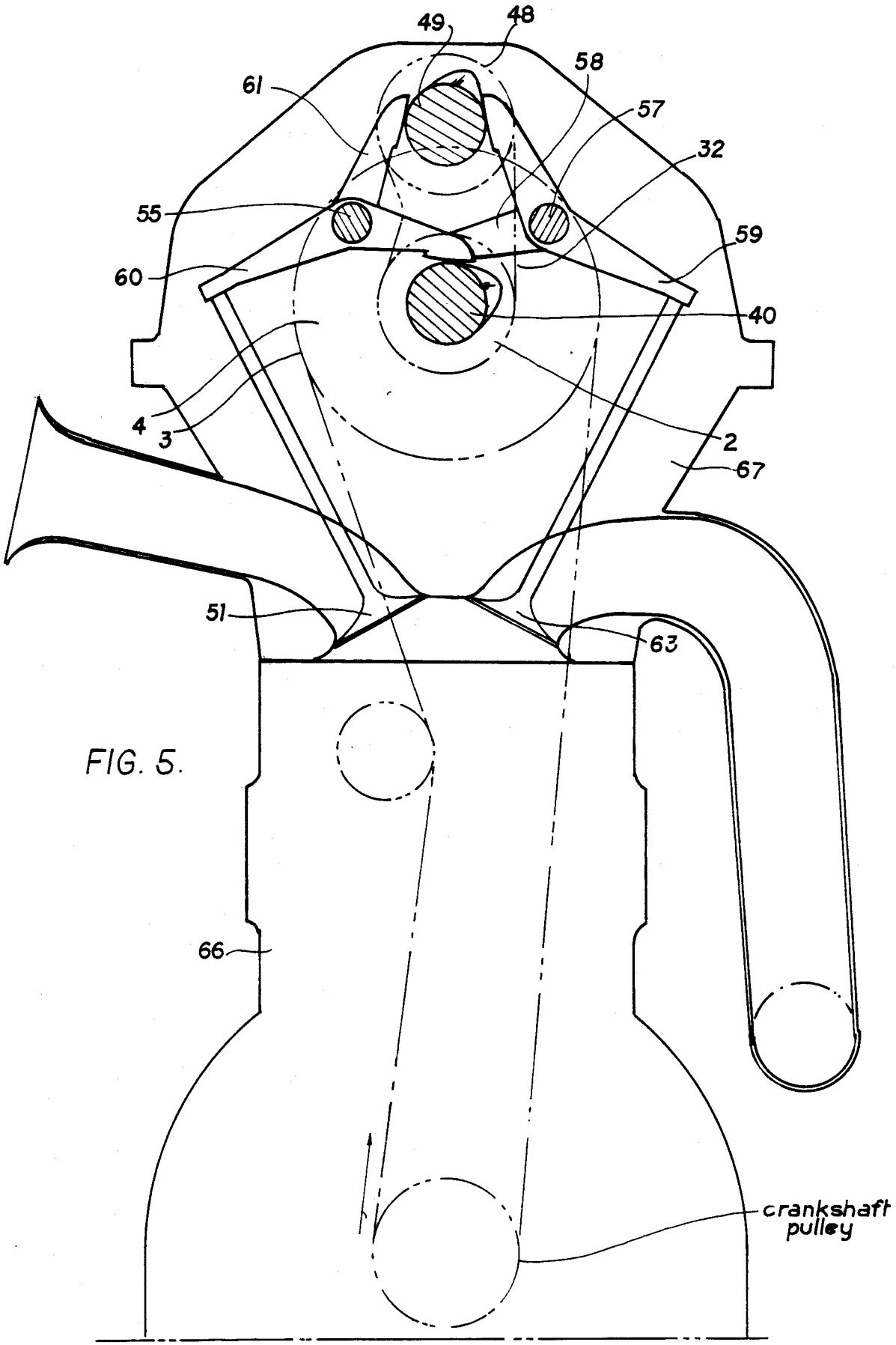
FIG. 5 is a frontal elevation of a variation of the mechanism using an alternative camshaft layout with rocker arms.

In FIG. 5 is shown another embodiment of the present invention. Depicted is a frontal elevation diagram of a layout for a four valve per combustion chamber engine. Shown are one of a pair of inlet valves 51, and one of a pair of exhaust valves 63. First camshaft 40 is shown with (in phantom) the camshaft indexing variator 4 to vary the relative angular indexing between first camshaft 40 and second camshaft 49. It will be noted that second camshaft 49 is disposed generally above first camshaft 40, relative to crankcase 66.

In order, in this embodiment, to facilitate location of all intake valves and ports on a first side of cylinder head 67, and all exhaust valves and ports on a second side of cylinder head 67, rocker arms are used to drivingly connect camlobes to the appropriate valves. Specifically, in FIG. 5 depicting this embodiment, intake valve 51, being one intake valve of a pair serving a single combustion chamber, is driven reciprocally by first rocker arm 60 pivoting about first rocker pivot 55; the other end of rocker arm 60 being reciprocated by an inlet camlobe on first camshaft 40. Second inlet valve 53 (not shown) is driven by second rocker arm 61 pivoted on first rocker arm pivot 55, the second rocker arm 61 being reciprocated by a camlobe on second camshaft 49.

First exhaust valve 63 is driven by third rocker arm 59 pivoted about second rocker arm pivot 57; the third rocker arm 59 being reciprocated by a camlobe on second camshaft 49. Second exhaust valve 65 (not shown) is driven by fourth rocker arm 58 reciprocated by a camlobe on first camshaft 40. Fourth rocker arm 58 is pivoted about second rocker arm pivot 57.

Figure 6:
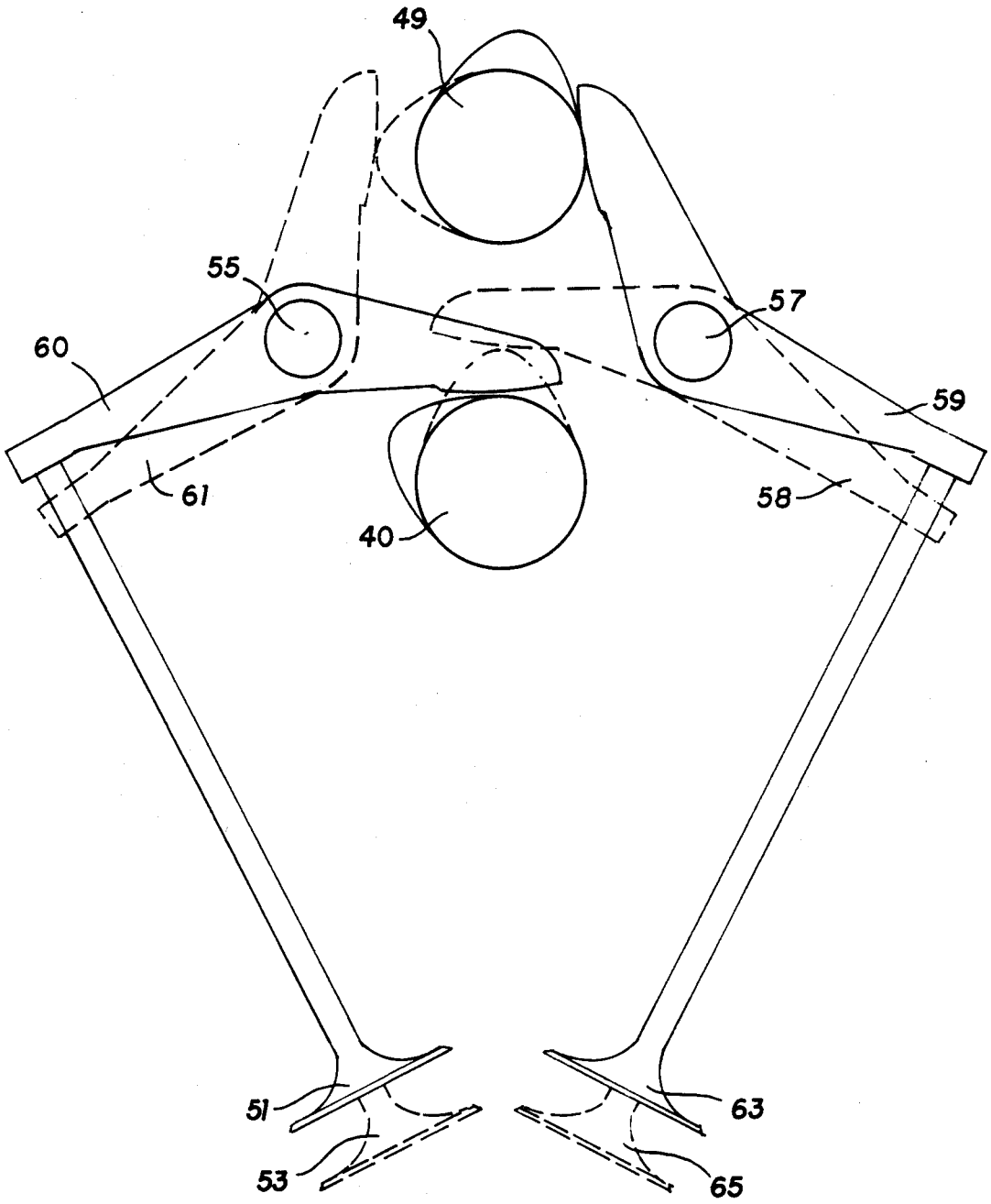
FIG. 6 is a depiction of the camshaft to rocker to valve relationship employed in the variation in FIG. 5.

FIG. 6 depicts another view of the same arrangement and shows in broken lines second inlet valve 53, second exhaust valve 65, and the rocker arms 61 and 58 that drive them. Valves 53 and 65 are depicted in open position. It should be noted that camlobe and valve phasing shown is selected purely to best illustrate the various components and some of their relationships, and is not intended to represent a working arrangement.

Figure 10:
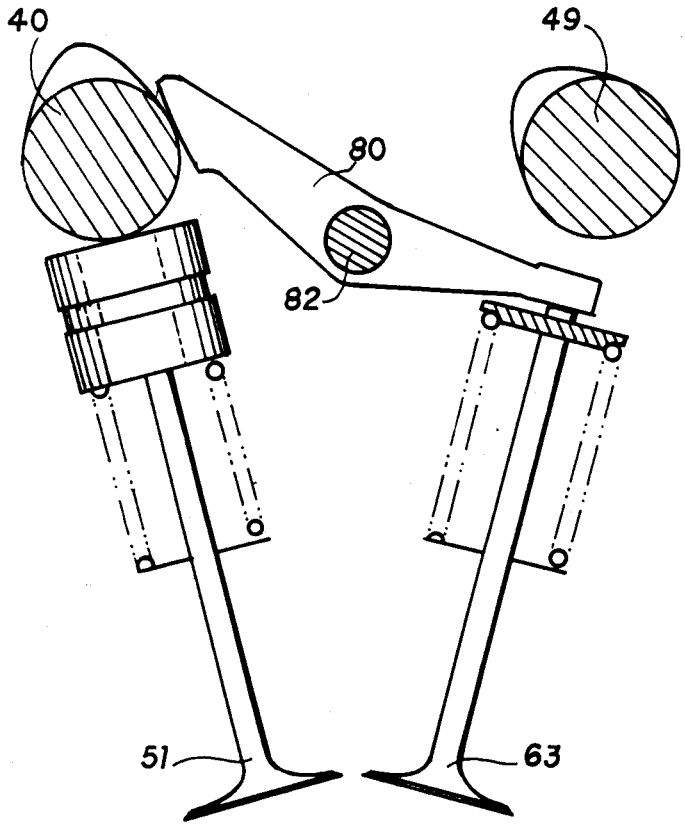
FIG. 10 is an alternative camshaft to rocker to valve arrangement for the invention.
Figure 11:
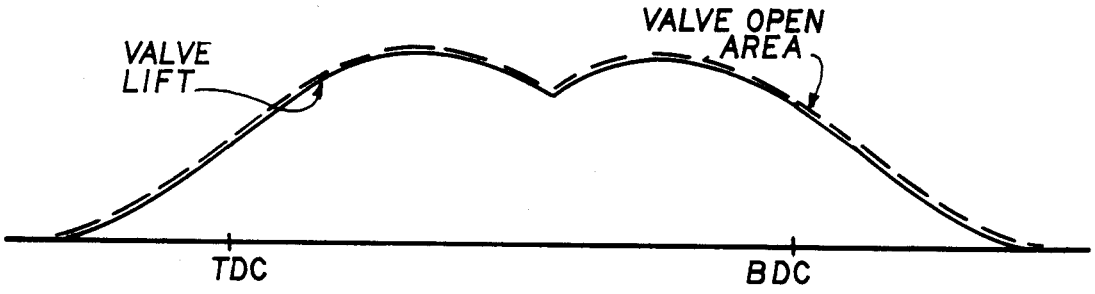
FIG. 11 is a depiction of curves of valve lift and valve open area of a single valve driven cooperatively by two camlobes at differential indexing.
Figure 12:
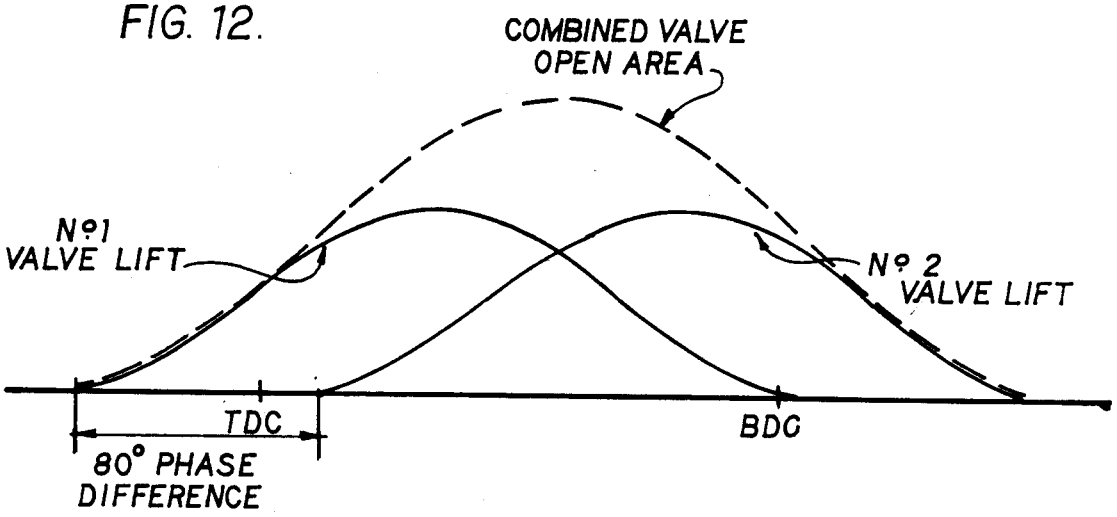
FIG. 12 is a depiction of curves of valve lift and valve open area of a pair of valves of common function driven by two camlobes at differential indexing.
Figure 13:
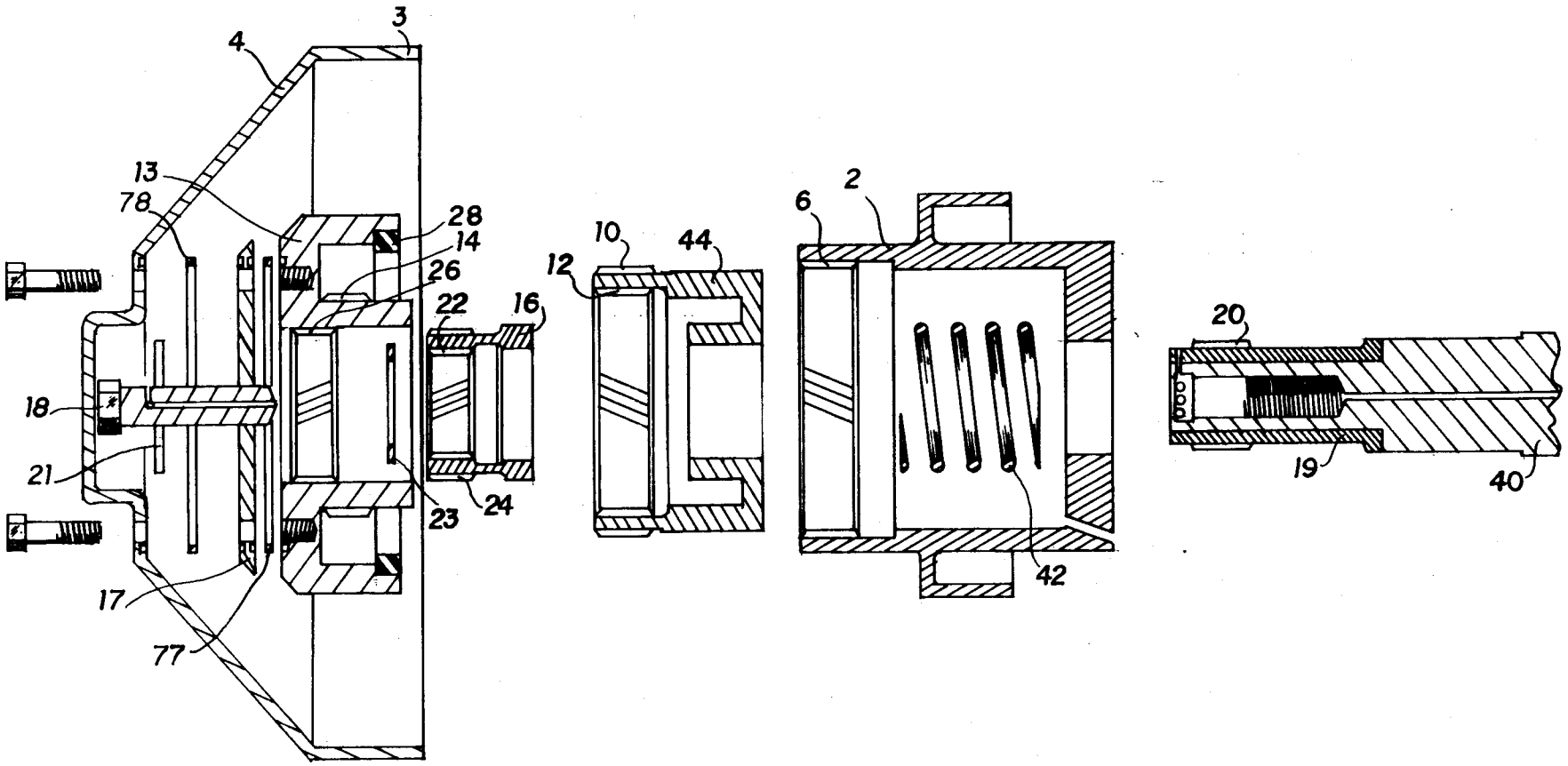
FIG. 13 is an exploded sectional drawing of the camshaft indexing variator 4.

A yet further embodiment of the present invention lies in an arrangement depicted in FIG. 10 wherein first and second camshafts 40 and 49 are disposed in a generally lateral way, and are parallel to each other. First inlet valve 51 is driven directly, in per se well known manner, by first camshaft 40, while first exhaust valve 63 is driven by first camshaft 40 reciprocating a first rocker arm 80 pivoting about rocker pivot 82.

Thus, a first inlet valve 51 and a first exhaust valve 63 are both driven by first camshaft 40. Although not shown in the drawing, second camshaft 49 drives a second inlet valve via a second rocker arm. and a second exhaust valve directly in per se well known manner Although not shown in drawing, first inlet valve 51, is driven by a first camlobe on first camshaft 40, while rocker arm 80, and thus first exhaust valve 63, is driven by a second camlobe on first camshaft 40. A similar arrangement allows second camshaft 49 to drive a second inlet valve and a second exhaust valve. Thus, of the four valves within a combustion chamber, the two inlet valves communicate, by means of an induction conduit, with inlet ports defined by portions of a first external surface of cylinder head 67, while the two exhaust valves communicate, by means of an exhaust conduit, with exhaust ports defined by portions of a second external surface of cylinder head 67; the arrangement herein described applying to any number of combustion chambers within an engine.

Figure 7:
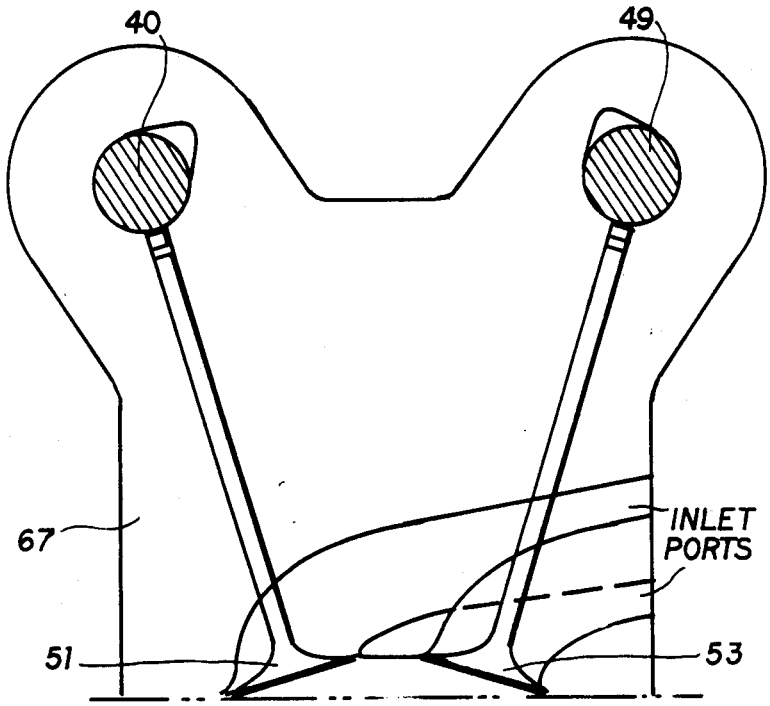
FIG. 7 is a diagram depicting an alternative porting arrangement for the invention.

A still further embodiment lies in the arrangement depicted in FIG. 7 wherein the two inlet valves 51 and 53 of a single combustion chamber, are driven directly, in per se well known manner, by first camshaft 40 and second camshaft 49 respectively; the induction conduits associated functionally with the two inlet valves 51 and 53 communicating with one of an inlet port defined by portions of an exterior surface of cylinder head 67, the aforesaid exterior surface of cylinder head 67 having only inlet ports.

Figure 8:
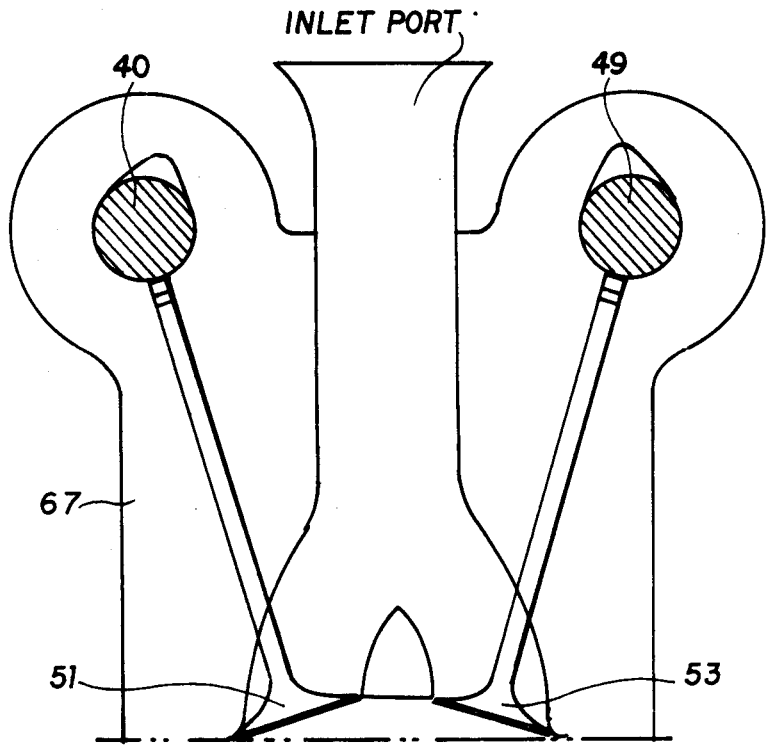
FIG. 8 is a diagram depicting another porting arrangement for the invention.

A yet further embodiment of the present invention is depicted in FIG. 8 wherein two inlet valves 51 and 53 serving a common combustion chamber are connected, by one of an induction conduit, to one of an inlet port defined by portions of an exterior surface of a cylinder head 67, the aforesaid exterior surface being situated adjacent to first camshaft 40 and second camshaft 49.

A yet further embodiment (not shown) lies in the arrangement wherein a first and a second exhaust valve are driven directly in per se well known manner, by a first camshaft and second camshaft respectively; the exhaust conduits associated functionally with the two exhaust valves communicating with one of an exhaust port defined by portions of a second exterior surface of a cylinder head; the aforesaid exterior surface of the cylinder head having only exhaust ports.

Another embodiment of the present invention lies in the arrangement (not shown) wherein a first and a second exhaust valve are driven by a first and a second camshaft respectively; the exhaust conduits associated functionally with the aforesaid valves communicating with one of an exhaust port located in an exterior surface of the cylinder head; the aforesaid exterior surface being located adjacent to the ;first and second camshafts.

A yet further aspect of the preferred embodiment of the present invention comes in the use of camlobe profiles of dissimilar characteristics within a pair of camlobes actuating a pair of valves jointly associated with a common process of induction or exhaust; thus allowing variations in the rate of increase of valve open area; and the rate of decrease of valve open area, during the opening and closing phases respectively, of the processes of induction and exhaust.

A further aspect of the present invention is in the use, where desirable, of different sized valves within a pair of valves jointly associated with one of a process of induction and exhaust within a combustion chamber, rather than using a pair of valves of identical size, as is conventional practice. This adaptation offering variations in the fields of turbulance, swirl and scavenging in the combustion chamber and cylinder of an internal combustion engine by varying rates of increase of valve open area, and rates of decrease of valve open area. Variations in volume and direction of gas flow and turbulance in the cylinder also result with different combinations of valve size.

A further aspect of the present invention lies in the variations in swirl, turbulance and scavenging offered by varying which valve of a pair jointly associated with a process of induction and exhaust within a combustion chamber opens first, this factor producing variations recognized in the art as desirable for optimizing performance.

The foregoing description of the preferred embodiments of the invention has been presented for the purposes of illustration and description. It is not intended to be exhaustive or to limit the invention to the precise form disclosed. Many modifications and variations are possible in the light of the above teaching. It is intended that the scope of the invention be limited not by this detailed description, but rather by the claims appended hereto.

What is claimed is:

1. A mechanism for actuating, within a combustion chamber of an internal combustion engine having a crankshaft, a pair of valves jointly associated functionally with one of a process of induction and exhaust, said mechanism comprising:

a first camshaft;

first means for reciprocating said first valve of said pair jointly associated functionally with one of a process of induction and exhaust by rotation of said first camshaft; a second camshaft;

second means for reciprocating said second valve of said pair jointly associated functionally with one of a process of induction and exhaust bY rotation of said second camshaft;

a controller to vary the angular relationship between said first camshaft and said second camshaft; said varying angular relationship between said first and said second camshafts varying the relationship between the phasing of said first and second valves of said pair jointly associated functionally with one of a process of induction and exhaust;

said varying phasing between said first and second valves of said pair jointly associated functionally with one of a process of induction and exhaust varying the duration, relative to crankshaft revolution, of a process of induction and exhaust associated functionally with said pair of valves.

2. A mechanism as in claim 1 wherein said controller comprises:

a first camshaft carrying a cam for driving at least one of an intake valve and an exhaust valve, said camshaft having a section formed with first helical gear teeth;

a first driven cam pulley engaging a first endless wrapping connector driven by the engine for rotation in synchronism with engine revolution, said first driven cam pulley having second helical gear teeth;

a first ring gear having an inner and outer helical gear teeth engagable with said first and said second gear teeth of said first camshaft and said first driven cam pulley respectively;

said first driven cam pulley having third helical gear teeth; an intermediate driven Pulley being of common axis with said first camshaft and having fourth helical gear teeth;

a second ring gear having inner and outer helical gear teeth engagable with said third and said fourth helical gear teeth of said first driven cam pulley and said intermediate driven pulley respectively;

said second helical gear teeth connecting operatively said first driven cam pulley and said first camshaft being of an orientation to produce an angular displacement between said first driven cam pulley and said first camshaft in a first rotational direction relative to crankshaft revolution;

said third helical gear teeth connecting operatively said first driven cam pulley and said intermediate driven pulley being of an orientation to produce an angular displacement between said first driven cam pulley and said intermediate driven pulley in a second rotational direction relative to crankshaft revolution;

a second camshaft carrying a cam for driving at least one of an intake valve and an exhaust valve;

said second camshaft having a second driven cam pulley fixed in rotation therewith;

a second endless wrapping connector drivingly connecting said intermediate driven pulley and said second driven cam pulley;

said first ring gear having a first and a second planar face;

said second ring gear having a first and a second planar face;

means for defining an enclosed hydraulic chamber facing said first planar face of said first ring gear and connected with a fluid pressure source to receive pressurized fluid therefrom;

said second planar face of said first ring gear engaging operatively said first Planar face of said second ring gear;

a spring means associated with said second planar face of said second ring gear for exerting an initial biasing force on said second ring gear in opposition to the force transmitted axially from said first ring gear to said second ring gear due to pressure on said first ring gear from said enclosed chamber;

means for controlling the hydraulic pressure introduced into said enclosed hydraulic chamber in accordance with engine operating conditions so as to shift said first ring gear between a first initial position, in which said first camshaft and said first driven cam pulley are in a predetermined first angular relationship with each other in which they drive said one of an inlet valve and an exhaust valve at first timing relative to engine revolution, and a second position, in which said first camshaft and said first driven cam pulley are angularly displaced relative to each other to a second angular relationship in which they drive said one of an inlet valve and an exhaust valve at second timing relative to engine revolution;

said axial shift of said first ring gear shifting axially said second ring gear between a first initial position in which said first driven cam pulley and said second camshaft are in a predetermined first angular relationship with each other in which they drive said one of an inlet valve and an exhaust valve at first timing relative to engine revolution, and a second position, in which said first driven cam pulley and said second camshaft are angularly displaced relative to each other to a second angular relationship in which they drive said one of an inlet valve and an exhaust valve at second timing relative to engine revolution;

said angular displacement of said first camshaft being of opposite rotational direction to said angular displacement of said second camshaft; said adjustment in timing, relative to crankshaft revolution, of said one of an inlet and exhaust valve driven by said first camshaft!, and said adjustment in timing, relative to crankshaft revolution, of said one of an inlet valve and an exhaust valve driven by said second camshaft, producing cooperatively an adjustment in the duration, relative to crankshaft revolution, of one of a process of induction and exhaust associated functionally with said valves.

3. The mechanism as in claim 2, wherein said means for controlling the pressure introduced into said enclosed hydraulic chamber comprises:

a hydraulic drain valve;

a hydraulic drain valve actuator, said hydraulic drain valve actuator actuating said hydraulic drain valve, in response to a signal generated by an engine management controller of per se well known type responding to engine sensors monitoring engine operating conditions, said hydraulic drain valve proportioning said hydraulic pressure to said enclosed hydraulic chamber, and wherein said first ring gear is exposed to said enclosed hydraulic chamber at one end so as to be urged axially in a first direction;

said axial motion of said first ring gear being transmitted to said second ring gear;

said axial motion of said first and second ring gears being opposed by spring means, whereby the lubricant pressure determines the axial relationships among said first driven cam pulley, said first ring gear, said first camshaft, said second ring gear, said intermediate driven pulley, said second driven cam pulley and said second camshaft fixed in rotation therewith, and thus determines the phase relationships among said first camshaft, said second camshaft and said crankshaft.

4. A mechanism for varying, relative to crankshaft revolution, the duration of the processes of induction and exhaust, in an internal combustion engine employing, within a combustion chamber, a pair of valves for each of the processes of induction and exhaust, the mechanism comprising:

a crankshaft;

a first camshaft;

a first rocker arm;

said first rocker arm being reciprocated by said first camshaft;

a first inlet valve;

said first inlet valve being reciprocated by said first rocker arm;

a second rocker arm;

said second rocker arm being reciprocated by said first camshaft;

a first exhaust valve;

said first exhaust valve being reciprocated by said second rocker arm;

a second camshaft;

a third rocker arm;

said third rocker arm being reciprocated by said second camshaft;

a second inlet valve;

said second inlet valve being reciprocated by said third rocker arm;

said fourth rocker arm being reciprocated by said second camshaft;

a second exhaust valve;

said second exhaust valve being reciprocated by said fourth rocker arm;

a system to vary the angular relationship between said first and said second camshafts, wherein said first camshaft has a section formed with first helical gear teeth;

a first driven cam pulley engages a first endless wrapping connector driven by the engine for rotation in synchronism with engine revolution, said first driven cam pulley having second helical gear teeth;

a first ring gear having inner and outer helical gear teeth engagable with said first and said second gear teeth of said first camshaft and said first driven cam pulley respectively; said first driven cam pulley having third helical gear teeth; an intermediate driven pulley being of common axis with said first camshaft and having fourth helical gear teeth;

a second ring gear having inner and outer helical gear teeth engagable with said third and said fourth helical gear teeth of said first driven cam pulley and said intermediate driven pulley respectively;

said second helical gear teeth connecting operatively said first driven cam pulley and said first camshaft being of an orientation to produce an angular displacement between said first driven cam pulley and said first camshaft in a first rotational direction relative to crankshaft revolution;

said third helical gear teeth connecting operatively said first driven cam pulley and said intermediate driven pulley being of an orientation to produce an angular displacement between said first driven cam pulley and said intermediate driven pulley in a second rotational direction relative to crankshaft revolution;

a second camshaft carrying a cam for driving at least one of an intake valve and an exhaust valve;

said second camshaft having a second driven cam pulley fixed in rotation therewith;

a second endless wrapping connector drivingly connecting said intermediate driven pulley and said second driven cam pulley;

said first ring gear having a first and a second planar face;

said second ring gear having a first and a second planar face;

means for defining an enclosed hydraulic chamber facing said first planar face of said first ring gear and connected with a fluid pressure source to receive pressurized fluid therefrom;

said second planar face of said first ring gear engaging operatively said first planar face of said second ring gear;

a spring means associated with said second planar face of said second ring gear for exerting an initial biasing force on said second ring gear in opposition to the force transmitted axially from said first ring gear to said second ring gear due to pressure on said first ring gear from said enclosed chamber;

means for controlling the hydraulic pressure introduced into said enclosed hydraulic chamber in accordance with engine operating conditions so as to shift said first ring gear between a first initial position and a second position, said shift of said first ring gear adjusting angular relationships among said first driven cam pulley, said first camshaft and said crankshaft;

said shift of said first ring gear between a first initial position and a second position shifting said second ring gear between a first initial position and a second position; said shift of said second ring gear adjusting the angular relationships among said first driven cam pulley, said intermediate driven pulley, and said crankshaft;

said adjustment in angular relationship between said first driven cam pulley and said intermediate driven pulley adjustinq the angular relationship between said first driven cam pulley and said second camshaft fast in rotation with said second driven cam pulley, by means of an endless wrapping connector drivingly connecting said intermediate driven pulley and said second driven cam pulley;

said adjustment in angular relationship, relative to crankshaft revolution, of said first camshaft, producing an adjustment in timing, relative to crankshaft revolution, of said intake and exhaust valves driven by said first camshaft;

said adjustment in angular relationship, relative to crankshaft revolution, of said second camshaft, producing an adjustment in timing, relative to crankshaft revolution, of said intake and exhaust valves driven by said second camshaft;

said adjustment in timing, relative to crankshaft revolution, of said intake and exhaust valves, producing an adjustment in duration, relative to crankshaft revolution, of the processes of induction and exhaust associated functionally with said valves.

5. A mechanism as in claim 4 wherein said means for controlling the hydraulic pressure introduced into said enclosed hydraulic chamber comprises:

one or more engine sensors;

said engine sensors monitoring one or more engine operating conditions;

an engine management controller;

said engine management controller receiving a signal generated by said engine sensors;

said engine management controller calculating engine requirements on the basis of said signal generated by said engine sensors; a hydraulic drain valve actuator;

said hydraulic drain valve actuator being actuated by a signal generated by said engine management controller;

a hydraulic drain valve;

said hydraulic drain valve being actuated by said hydraulic drain valve actuator to proportion the hydraulic pressure fed to said enclosed hydraulic chamber.

6. A mechanism as in claim 4 further comprising:

said first camshaft being disposed generally between said second camshaft and said combustion chamber.

7. A mechanism as in claim 4 further comprising: said second camshaft being disposed generally between said first camshaft and said combustion chamber

8. A mechanism as in claim 1 further comprising: a cylinder head having a combustion chamber;

a first inlet valve;

a second inlet valve;

a first exhaust valve;

a second exhaust valve;

a first induction conduit associated functionally with said first inlet valve of said combustion chamber;

said first induction conduit communicating fluidly with a first inlet port defined by portions of a first exterior surface of said cylinder head;

a second induction conduit associated functionally with said second inlet valve of said combustion chamber;

said second induction conduit communicating fluidly with a second inlet port defined by portions of a second exterior surface of said cylinder head;

a first exhaust conduit associated functionally with said first exhaust valve of said combustion chamber;

said first exhaust conduit communicating fluidly with a first exhaust port defined bY portions of said first exterior surface of said cylinder head;

a second exhaust conduit associated functionally with said second exhaust valve of said combustion chamber;

said second exhaust conduit communicating fluidly with a second exhaust port defined by portions of said second exterior surface of said cylinder head;

said first exterior surface of said cylinder head having inlet ports and exhaust ports;

said second exterior surface of said cylinder head having inlet ports and exhaust ports.

9. A mechanism as in claim 1 further comprising:

a cylinder head;

a pair of inlet valves;

an induction conduit associated functionally with said pair of inlet valves;

said induction conduit communicating fluidly with an inlet port defined by portions of a first exterior surface of said cylinder head, said first exterior surface of said cylinder head having only inlet ports;

an exhaust conduit associated functionally with said pair of exhaust valves;

said exhaust conduit communicating fluidly with an exhaust port defined by portions of a second exterior surface of said cylinder head, said second exterior surface of said cylinder head having only exhaust ports.

10. A mechanism as in claim 1 further comprising:

a cylinder head;

a first camshaft;

a second camshaft;

a conduit associated functionally with one of a process of induction and exhaust;

a pair of valves jointly associated functionally with one of a process of induction and exhaust;

said conduit connecting said pair of valves with a port defined by portions of an exterior surface of said cylinder head;

said exterior surface of said cylinder head being adjacent to said first and second camshafts.

11. A mechanism as in claim 1 further comprising:

a combustion chamber;

a pair of valves jointly associated functionally with one of a process of induction and exhaust within said combustion chamber;

said pair of valves jointly associated functionally with one of a process of induction and exhaust being of different sizes.

12. A mechanism as in claim 11 further comprising:

a combustion chamber;

a pair of valves jointly associated functionally with one of a process of induction and exhaust within a combustion chamber;

a valve of said pair of valves jointly associated functionally with one of a process of induction and exhaust having priority of opening.

13. A mechanism as in claim 12 further comprising:

a first camshaft having a first camlobe;

a second camshaft having a second camlobe;

a pair of valves jointly assoCiated functionally with one of a process of induction and exhaust;

said first and second camlobes driving said pair of valves jointly associated functionally with one of a process of induction and exhaust being of dissimilar profiles.

14. A mechanism as in claim 2 wherein said controller further comprises:

said first driven cam pulley being detachable from said camshaft indexing variator to facilitate servicing of said endless wrapping connector drivingly connecting said intermediate driven pulley and said second driven cam pulley without further dismantling of said cam$haft indexing variator.

15. A mechanism as in claim 1 further comprising;

a combustion chamber;

a first camlobe on said first camshaft driving a first inlet valve within said combustion chamber directly in per se well known manner;

a second camlobe on said first camshaft driving a first exhaust valve within said combustion chamber by means of a rocker arm;

a first camlobe on said second camshaft driving a second exhaust valve within said combustion chamber directly in per se well known manner;

a second camlobe on said second camshaft driving a second inlet valve within said combustion chamber by means of a rocker arm.

* * * * *